US011817251B2

(12) United States Patent
Koo et al.

(10) Patent No.: US 11,817,251 B2
(45) Date of Patent: Nov. 14, 2023

(54) ELECTRONIC COMPONENT

(71) Applicant: SAMSUNG ELECTRO-MECHANICS CO., LTD., Suwon-si (KR)

(72) Inventors: Kun Hoi Koo, Suwon-si (KR); Byung Woo Kang, Suwon-si (KR); Ji Hye Han, Suwon-si (KR); Bon Seok Koo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 193 days.

(21) Appl. No.: 17/514,292

(22) Filed: Oct. 29, 2021

(65) Prior Publication Data

US 2022/0051843 A1 Feb. 17, 2022

Related U.S. Application Data

(63) Continuation of application No. 15/807,001, filed on Nov. 8, 2017, now Pat. No. 11,183,325.

(30) Foreign Application Priority Data

Mar. 2, 2017 (KR) ..... 10-2017-0027157

(51) Int. Cl.
*H01F 27/28* (2006.01)
*H01F 27/29* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 27/2804; H01F 2027/2809; H01F 17/0013; H01F 17/0006; H01F 5/003;
(Continued)

(56) References Cited

U.S. PATENT DOCUMENTS 6,218,925 B1 * 4/2001 Iwao ..... H01F 27/292 336/200
6,252,481 B1 * 6/2001 Iwao ..... H01F 41/043 336/200
(Continued)

FOREIGN PATENT DOCUMENTS

CN 1993784 A 7/2007
CN 101246777 A 8/2008
(Continued)

OTHER PUBLICATIONS

Office Action issued in corresponding Japanese Patent Application No. 2019-024396 dated Nov. 19, 2019, with English translation.
(Continued)

*Primary Examiner* — Tszfung J Chan
(74) *Attorney, Agent, or Firm* — Morgan, Lewis & Bockius LLP

(57) ABSTRACT

An electronic component includes an internal electrode and an external electrode electrically connected thereto. The external electrode includes a conductive base having a porous structure and a resin filled in voids in the porous structure of the conductive base. The electronic component further includes a connection layer disposed between the internal electrode and the external electrode.

21 Claims, 3 Drawing Sheets

(51) Int. Cl.
*H01F 17/04* (2006.01)
*H01F 17/00* (2006.01)

(52) U.S. Cl.
CPC ..... *H01F 27/29* (2013.01); *H01F 27/292* (2013.01); *H01F 2017/048* (2013.01); *H01F 2027/2809* (2013.01)

(58) Field of Classification Search
CPC ..... H01F 27/29; H01F 27/292; H01F 17/04; H01F 2017/048
USPC ..... 336/200, 232
See application file for complete search history.

(56) References Cited

U.S. PATENT DOCUMENTS

| | | | | |
|---|---|---|---|---|
| 6,479,763 | B1 | 11/2002 | Tgaki et al. | |
| 2001/0017420 | A1* | 8/2001 | Iwao | H01F 17/0013 257/693 |
| 2006/0044098 | A1 | 3/2006 | Kimura et al. | |
| 2009/0085216 | A1 | 4/2009 | Tanaka et al. | |
| 2010/0157565 | A1 | 6/2010 | Yoshida | |
| 2013/0106560 | A1* | 5/2013 | Zenzai | H01F 27/292 361/321.1 |
| 2013/0164956 | A1 | 6/2013 | Sakuyama et al. | |
| 2015/0016018 | A1 | 1/2015 | Onishi | |
| 2015/0187500 | A1* | 7/2015 | Kang | H01G 4/30 427/79 |
| 2015/0314371 | A1 | 11/2015 | Terao | |
| 2018/0033540 | A1 | 2/2018 | Lee | |
| 2018/0308626 | A1* | 10/2018 | Kato | H01F 41/04 |

FOREIGN PATENT DOCUMENTS

| | | | |
|---|---|---|---|
| CN | 103178037 | A | 6/2013 |
| EP | 1 783 790 | A | 5/2007 |
| JP | H08-107038 | A | 4/1996 |
| JP | H11-350190 | A | 12/1999 |
| JP | 2000-0182883 | A | 6/2000 |
| JP | 2000-215729 | A | 8/2000 |
| JP | 2001-244116 | A | 9/2001 |
| JP | 2008-091433 | A | 4/2008 |
| JP | 2009-54790 | A | 3/2009 |
| JP | 2011-77225 | A | 4/2011 |
| JP | 2011-143442 | A | 7/2011 |
| JP | 2015-026839 | A | 2/2015 |
| KR | 10-2010-0110891 | A | 10/2010 |
| WO | 2004/053901 | A1 | 6/2004 |
| WO | 2009098938 | A1 | 8/2009 |

OTHER PUBLICATIONS

Office Action issued in corresponding Chinese Patent Application No. 201810034354.6 dated Mar. 27, 2020, with English translation.
Office Action issued in Japanese Application No. 2019-024396 dated Jun. 4, 2019, with English translation.
Office Action issued in corresponding Japanese Application No. 2017-214710 dated Jul. 17, 2018.
Office Action issued in corresponding Korean Application No. 10-2017-0027157 dated Mar. 13, 2018, with English translation.
Notice of Allowance issued in corresponding U.S. Appl. No. 15/807,001 dated Jul. 22, 2021.
Office Action issued in corresponding U.S. Appl. No. 15/807,001 dated Mar. 18, 2021.
Final Office Action issued in corresponding U.S. Appl. No. 15/807,001 dated May 21, 2020.
Office Action issued in corresponding U.S. Appl. No. 15/807,001 dated Oct. 9, 2019.

* cited by examiner

ELECTRONIC COMPONENT

CROSS-REFERENCE TO RELATED APPLICATION(S)

This application is the continuation application of U.S. patent application Ser. No. 15/807,001 filed on Nov. 8, 2017, which claims the benefit of priority to Korean Patent Application No. 10-2017-0027157 filed on Mar. 2, 2017 in the Korean Intellectual Property Office, the disclosures of which are incorporated herein by reference in their entirety.

BACKGROUND

1. Field

The present disclosure relates to an electronic component, and more particularly, to a passive element component such as an inductor or a common mode filter.

2. Description of Related Art

In passive element components such as an inductor and a common mode filter, as an internal electrode, a coil may be formed using a copper coil. Even in the case that the same amount of current flows to a passive element component such as an inductor, such a passive element component should be used smoothly without significantly increasing a temperature. To this end, a saturation current (Isat) should be high, and a direct current resistance (Rdc) value of the passive element component should be stably maintained without change, even in a case in which an exposure to an elevated temperature or a mechanical impact is applied thereto.

In a case of using an Ag-epoxy based paste in external electrodes in order to satisfy Rdc of the passive element component as described above, as an epoxy is cured, a distance between Ag particles is decreased, such that a conduction path may be formed, and a conduction path may also be formed by physical contact between Ag particles and a copper terminal electrode of the passive element component, such that Rdc of an entire component may be decreased.

However, since a contact between Ag in the Ag-epoxy based paste of the external electrode and the copper terminal electrode is a physical contact, the Rdc value may be increased by an exposure to high temperature, or the absorption of moisture, chlorinated water, or the like, such that reliability may be deteriorated.

SUMMARY

An aspect of the present disclosure may provide an electronic component in which contact properties between an internal coil and external electrodes connected thereto are significantly improved.

According to an aspect of the present disclosure, an electronic component includes: an internal electrode; and external electrodes electrically connected to the internal electrode. The external electrode includes a conductive base having a porous structure and a resin filled in voids in the porous structure, and a connection layer is disposed between the external electrode and the internal electrode.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, an electronic component according to an exemplary embodiment in the present disclosure will be described, but is not necessarily limited thereto.

Figure 1:
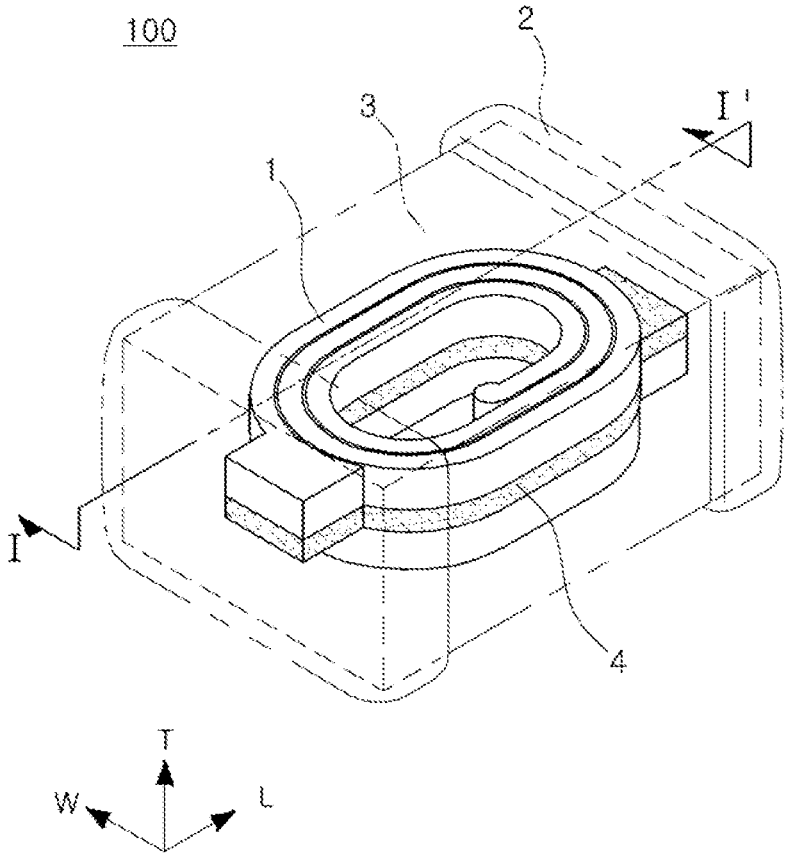
FIG. 1 is a schematic perspective view of an electronic component according to an exemplary embodiment in the present disclosure.

FIG. 1 is a schematic perspective view of an electronic component according to an exemplary embodiment in the present disclosure. Hereinafter, a thin film inductor will be mainly described as an example of the electronic component, but the present disclosure may also be applied to other electronic components such as other types of inductors, a common mode filter, a capacitor, and the like. Particularly, the electronic component according to the exemplary embodiment in the present disclosure may be applied in a case where copper is used as an internal electrode in a passive element component.

Referring to FIG. 1, an electronic component 100 may include an internal electrode 1 forming a coil and external electrodes 2 electrically connected to the internal electrode.

The internal electrode may be encapsulated by a body 3 forming an exterior of the electronic component, and the body may be formed of a magnetic particle-resin composite having magnetic properties. For example, the body 3 may be formed by filling ferrite or a metal-based soft magnetic material. Here, an example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal-based soft magnetic material may be an alloy containing any one or more selected from the group consisting of Fe, Si, Cr, Al, and Ni. For example, the metal-based soft magnetic material may contain Fe—Si—B—Cr based amorphous metal particles, but is not limited thereto. The metal-based soft magnetic material may have a particle size within a range from 0.1 μm or more to 20 μm or less. The ferrite or metal-based soft magnetic material may be contained in a form in which the ferrite or metal-based soft magnetic material is dispersed on a polymer such as an epoxy resin, polyimide, or the like, thereby forming the body.

The body 3 may form an entire exterior of the electronic component, have upper and lower surfaces opposing each other in a thickness (T) direction, first and second end surfaces opposing each other in a length (L) direction, and first and second side surfaces opposing each other in a width (W) direction, and may have a substantially hexahedral shape as illustrated in FIG. 1. However, the body 3 is not limited thereto.

The body 3 may include a support member 4 supporting the internal electrode 1, and the support member may serve to suitably support the internal electrode and allow the internal electrode 1 to be more easily formed. The support member 4 may have a plate shape and may have insulating properties. For example, the support member 4 may be a printed circuit board (PCB), but is not limited thereto. The support member 4 may have a thickness sufficient to support the internal electrode 1. For example, the thickness of the support member 4 may preferably be about 60 μm.

The internal electrode 1 supported by the support member 4 may be a coil having a spiral shape, and a method of forming the coil is not particularly limited. For example, an anisotropic plating method in which a growth rate of a coil in a thickness direction is larger than a growth rate of the coil in a width direction, or an isotropic plating method in which the growth rate of the coil in the width direction is substantially equal to that of the coil in the thickness direction, may be used.

Since a material of the internal electrode 1 is not limited as long as both end portions of the internal electrode 1 may be electrically connected to the external electrode 2, respectively, the internal electrode 1 may contain a metal having excellent electric conductivity. For example, the internal electrode 1 may be formed of silver (Ag), palladium (Pd), aluminum (Al), nickel (Ni), titanium (Ti), gold (Au), copper (Cu), platinum (Pt), or alloys thereof, or the like. Particularly, in view of connectivity between the internal and external electrodes 1 and 2, the internal electrode 1 may be formed of copper (Cu).

The external electrode 2 may be formed by a dipping method using a metal-resin composite paste. However, a method of forming the external electrode 2 is not limited thereto. The external electrode 2 may be formed using an Ag—Sn based solder-epoxy based paste instead of an existing Ag-epoxy based paste. Here, a Sn based solder may be, for example, a powder represented by Sn, $Sn_{96.5}Ag_{3.0}Cu_{0.5}$, $Sn_{42}Bi_{58}$, $Sn_{72}Bi_{28}$, or the like, but is not limited thereto. In this case, a weight ratio of conductive particles having a high melting point except for the epoxy in the paste, for example, Ag particles, and solder particles, for example, the Sn solder may be preferably 55:45 or more to 70:30 or less. In other words, a content of the conductive particles having a high melting point may be within a range from 55 wt % or more to 70 wt % or less, based on a sum of weights of the conductive particles having a high melting point and the solder particles in an external electrode paste. In this case, a connection layer 5 between the internal electrode 1 and the external electrode 2 may be stably formed.

Figure 2:
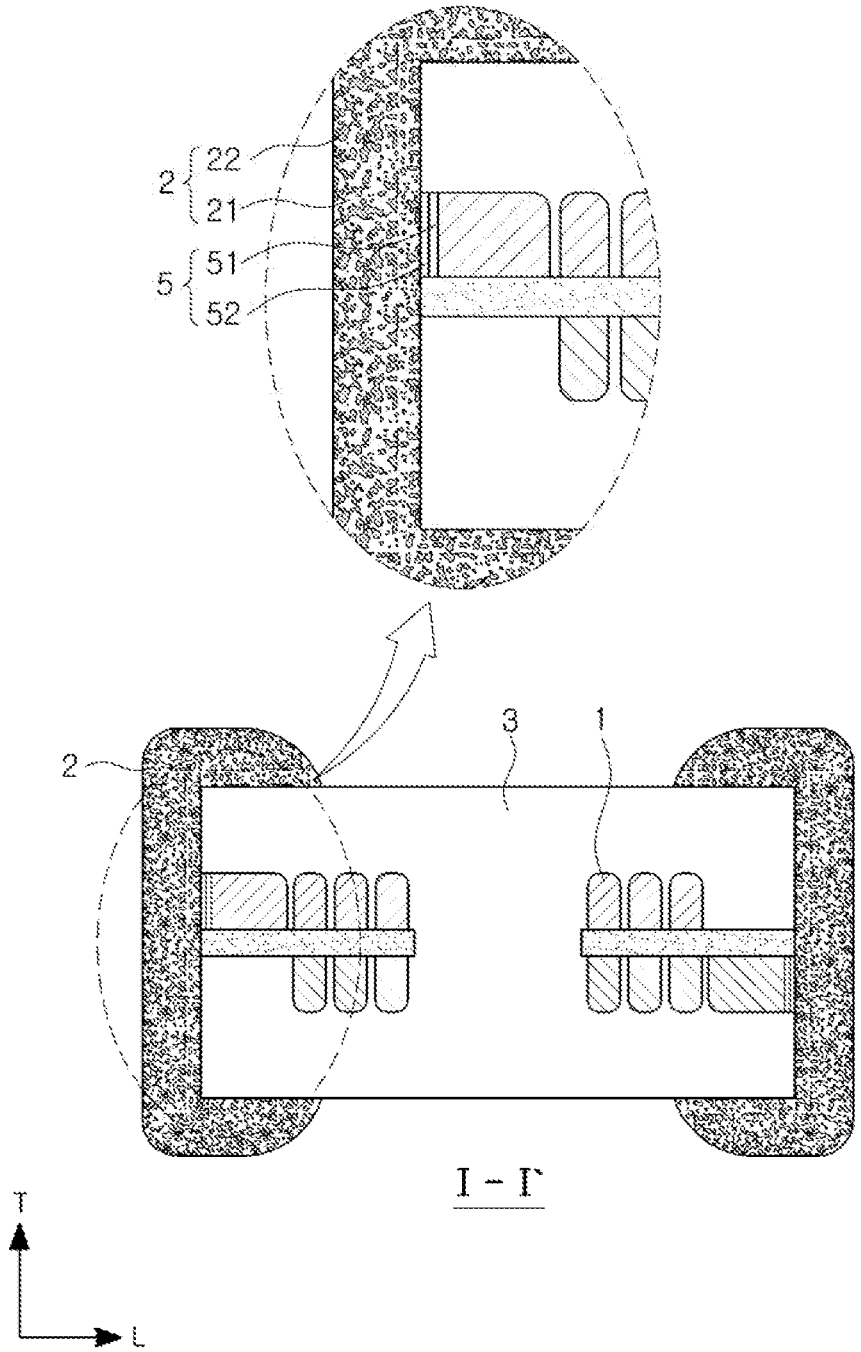
FIG. 2 is a cross-sectional view taken along line I-I' of FIG. 1.

FIG. 2 is a schematic cross-sectional view taken along line I-I' of FIG. 1. An internal structure of the external electrode 2 will be described in more detail with reference to FIG. 2.

Referring to FIG. 2, the external electrode 2 may include a conductive base 21 having a porous structure and a thermosetting resin 22 filled in voids in the porous structure. The conductive base of the external electrode 2 forms a continuous network structure extending from an internal side to an external side of the external electrode 2.

For reference, hereinafter, an example of a process of forming the external electrode 2 electrically connected to the internal electrode 1 is described, but the external electrode of the electronic component according to the present disclosure is not limited to being formed only by the process to be described below by way of example.

First, an external electrode paste may be prepared by mixing silver (Ag) powder having a substantially spherical shape while having a particle size of about 0.5 μm to 3 μm and Sn—Bi based solder powder with each other at a predetermined ratio, and then additionally adding an epoxy additive thereto. A method of preparing the external electrode paste is not limited. For example, a vacuum planetary mixer may be used. After the external electrode paste prepared as described above is finally dispersed by revolution and rotation, the external electrode paste may be printed on an outer surface of the body at a predetermined thickness by a dipping-coating method. Then, after the dipping-coated external electrode paste is dried, the paste may be applied again on a portion of the body opposite to a portion of the body coated by the external electrode paste. After the application and drying are completed, curing may be performed. In order to prevent oxidation of a Sn based solder ingredient, it is preferable that an inert atmosphere is maintained at the time of curing.

The external electrode 2 manufactured as described above may include the conductive base 21 having the porous structure and the thermosetting resin 22 filled in the voids in the porous structure.

The conductive base 21 may contain an Ag—Sn based alloy, for example, an $Ag_3Sn$ alloy, but is not limited thereto.

Ag particles or solder particles contained in the external electrode paste may be additionally contained in $Ag_3Sn$ of the conductive base, and the Ag particles, solder particles, or the like, may be irregularly dispersed in the conductive base. Of course, the Ag particles or solder particles may be particles derived from ingredients initially contained in the external electrode paste. Particularly, the solder particles may include a solder in a state in which the solder does not completely participate in a reaction but remains through application, drying, and curing processes, etc., of the external electrode. The solder remaining after the reaction as described above may include a solder in a state in which a composition of the Sn based solder particles is changed. For example, in a case of using a Sn—Bi based solder in the external electrode paste, the remaining solder may be a solder in which an amount of Sn is decreased and a large amount of Bi is contained, or only Bi remains. In a case in which only Bi remains, it may be confirmed that Bi particles are irregularly disposed on an external boundary surface of the conductive base. The Bi particle may also be continuously connected to a Bi particle adjacent thereto.

Although a detailed description will be omitted, among the solder particles initially used as a raw material to prepare the external electrode paste in the conductive base 21, solder particles which do not participate in the reaction and of which a composition and a content are maintained as they are without change may be irregularly dispersed in the conductive base of the external electrode.

Here, an $Ag_3Sn$ intermetallic compound forming an entire backbone of the conductive base 21 may be contained in the entire external electrode in a content range of 30 vol % to 60 vol %, and the Ag particles irregularly dispersed therein may be contained in a content of 0 vol % to 3 vol %. In addition, the epoxy filled in the voids in the conductive base may be contained in a content range of 40 vol % to 70 vol %.

Further, a connection layer 5 may be disposed between the internal electrode 1 and the external electrode 2. The connection layer 5 may serve as a boundary surface preventing interfacial delamination between the internal electrode 1 and the external electrode 2. The connection layer 5 may have an average thickness of 1 μm or more to 10 μm or less. In a case in which the thickness of the connection layer 5 is less than 1 μm, a function of the connection layer may not be appropriately exhibited. However, in a case in which the average thickness is more than 10 μm, when the connection layer 5 partially has brittleness, a side effect in which the connection layer 5 is broken may occur.

The connection layer 5 may include a first connection layer 51 adjacent to the external electrode 2 and a second connection layer 52 adjacent to the internal electrode 1. The first connection layer 51 may be formed of a $Cu_6Sn_5$ alloy, and the second connection layer 52 may be formed of a $Cu_3Sn$ alloy. A Cu ingredient contained in both the first and second connection layers may be derived from an electric conductive compound contained in the internal electrode, and a Sn ingredient may be derived from a solder ingredient contained in the external electrode paste. As a specific mechanism, for example, in a case of selecting the Ag—Sn based solder-epoxy based compound as the external electrode paste, a Sn ingredient may remain, depending on a molar ratio of the added Sn based solder and Ag particles, and this residual Sn ingredient and a copper ingredient in the internal electrode may form an intermetallic compound again, such that the connection layer may be formed.

Although a case in which the first and second connection layers 51 and 52 form continuous boundary surfaces between the internal electrode and the external electrode is illustrated in FIG. 2, the first and second connection layers 51 and 52 may also be changed so that at least one of the first and second connection layers 51 and 52 is discontinuously formed by controlling the molar ratio between the Sn ingredient and Ag ingredient in the external electrode paste or the content of the Sn ingredient.

Figure 3A:
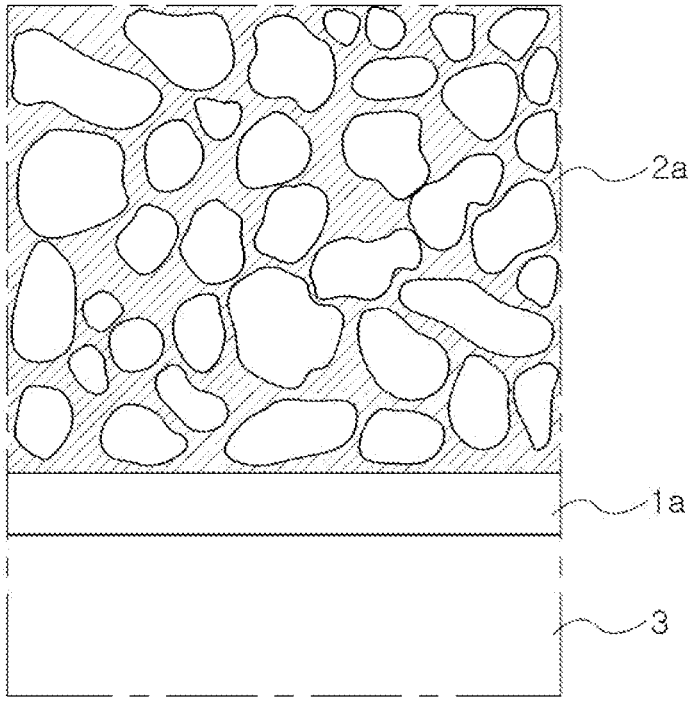
FIGS. 3A and 3B are schematic mimetic views illustrating cross sections of portions of entire regions from external electrodes to internal electrodes in Comparative Example 1 and Example 1, respectively.
Figure 3B:
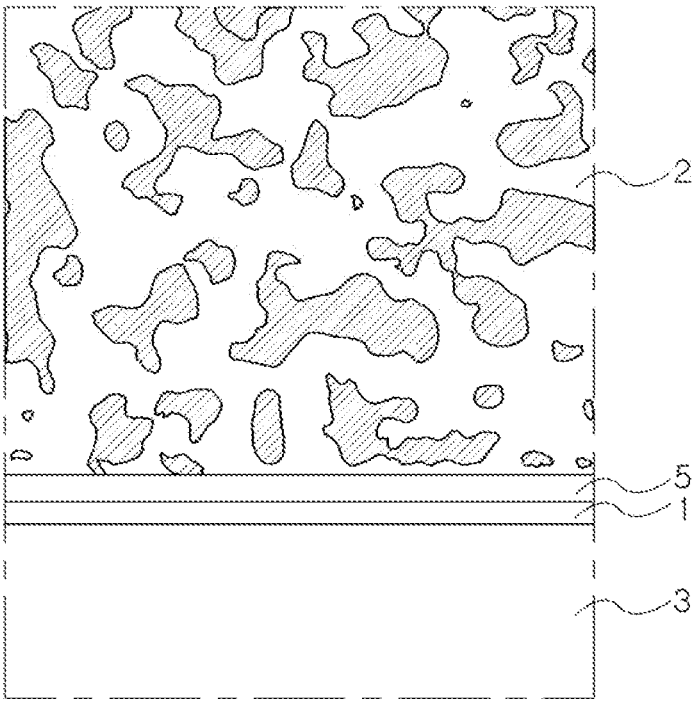

FIGS. 3A and 3B are schematic mimetic views illustrating cross sections of portions of entire regions from external electrodes to internal electrodes in Comparative Example 1 and Example 1, respectively.

It may be appreciated from FIGS. 3A and 3B that in Comparative Example 1, depicted in FIG. 3A, internal and external electrodes are connected to each other only through a physical contact, but in Example 1, depicted in FIG. 3B, an intermetallic compound (IMC) is interposed between internal and external electrodes. Further, it may be appreciated from FIG. 3B that thermal impact properties in Example 1 corresponding to the electronic component according to the exemplary embodiment in the present disclosure are excellent as compared to thermal impact properties in Comparative Example 1 corresponding to an inductor containing an Ag-epoxy based external electrode paste according to the related art.

First, referring to FIG. 3A, Comparative Example 1 is different from Example 1 in that the above-mentioned structures of the external electrode formed using the Ag—Sn based solder-epoxy based external electrode paste and the connection layer are not included. In Comparative Example 1, since only the physical contact is present between the internal electrode and the external electrode but there is no continuous bond between conductive metals in the external electrode itself, it is predicted that interfacial delamination will easily occur. On the contrary, in Example 1, interfacial delamination will be less likely to occur due to the presence of a connection layer, which is a double layer of an intermetallic compound, and external electrode having a continuous network structure.

Next, a change in Rdc value of the electronic component according to the exemplary embodiment in the present disclosure before and after a soldering heat-resistance test and a change in Rdc value of the electronic component according to the related art before and after the soldering heat-resistance test will be compared with reference to Tables 1 to 3. Tables 1 and 2 illustrate changes in Rdc values of electronic components according to Examples 1 and 2, respectively, and Table 3 illustrates a change in Rdc value of an electronic component according to Comparative Example 1. Conditions for the soldering heat-resistance test are as follows. After an initial Rdc value of a sample to be subjected to the soldering heat-resistance test is measured, a temperature of a soldering bath is set to 450° C., and a later Rdc value is measured after dipping the sample in the soldering bath at a temperature of 450° C. for 5 seconds, picking out the sample, and cooling the sample to room temperature.

In both Examples 1 and 2, an external electrode paste formed of a composition containing a solder ingredient corresponding to a metal ingredient having a low melting point was commonly used, but Example 2 was different from Example 1 only in that the external electrode paste formed of an Ag-solder based particles-epoxy based compound, Ag-coated copper particles were partially used instead of Ag particles. The external electrode paste in Example 1 contained 63 wt % of Ag coarse powder, 7 wt % of Ag fine powder, and 30 wt % of solder, and further contained 8 wt % of an epoxy based on an entire content (100 wt %) of a metal filler. Similarly to Example 1, the external electrode paste in Example 2 contained 59 wt % of Ag coarse powder, 3 wt % of Ag fine powder, 5 wt % of Ag-coated copper powder, and 33 wt % of solder, and further contained 8 wt % of an epoxy based on an entire content (100 wt %) of a metal filler.

TABLE 1

| 450° C. | Initial Value | Later value | Change Rate |
|---|---|---|---|
| 1 | 127.85 | 133.52 | 6% |
| 2 | 128.58 | 134.34 | 6% |
| 3 | 131.22 | 134.04 | 3% |
| 4 | 125.61 | 129.3 | 4% |
| 5 | 135.12 | 137.78 | 3% |
| 6 | 123.75 | 128.1 | 4% |
| 7 | 128.74 | 134.11 | 5% |
| 8 | 130.4 | 137.67 | 7% |
| 9 | 136.12 | 143.38 | 7% |
| 10 | 121.16 | 126.86 | 6% |
| MIN | 121.16 | 126.86 | 3% |
| MAX | 136.12 | 143.38 | 7% |
| AVG | 128.855 | 133.91 | 5% |
| STD | 4.677531 | 4.987763 | 0.016415 |

TABLE 2

| 450° C. | Initial Value | Later value | Change Rate |
|---|---|---|---|
| 1 | 130.46 | 135.72 | 5% |
| 2 | 119.78 | 126.75 | 7% |
| 3 | 131.78 | 138.17 | 6% |
| 4 | 127.59 | 132.9 | 5% |
| 5 | 123.12 | 127.55 | 4% |
| 6 | 124.48 | 128.25 | 4% |
| 7 | 136.17 | 138.12 | 2% |
| 8 | 133.57 | 135.12 | 2% |
| 9 | 133.67 | 134.74 | 1% |
| 10 | 135.36 | 137.74 | 2% |
| MIN | 119.78 | 126.75 | 1% |
| MAX | 136.17 | 138.17 | 7% |
| AVG | 129.598 | 133.506 | 4% |
| STD | 5.605925 | 4.461047 | 0.020924 |

TABLE 3

| 450° C. | Initial Value | Later value | Change Rate |
|---|---|---|---|
| 1 | 146.53 | 153.46 | 7% |
| 2 | 137.01 | 1637.95 | 1501% |
| 3 | 139.36 | 144.41 | 5% |
| 4 | 147.94 | 149.76 | 2% |
| 5 | 151.64 | 152.02 | 0% |

TABLE 3-continued

| 450° C. | Initial Value | Later value | Change Rate |
|---|---|---|---|
| 6 | 146.34 | 148.93 | 3% |
| 7 | 145.28 | 176.74 | 31% |
| 8 | 147.9 | 149.44 | 2% |
| 9 | 157.46 | 161.04 | 4% |
| 10 | 151.77 | 216.25 | 64% |
| MIN | 137.01 | 144.41 | 0% |
| MAX | 157.46 | 1637.95 | 1501% |
| AVG | 147.123 | 309 | 162% |
| STD | 5.935028 | 467.4351 | 4.709359 |

As illustrated in Tables 1 to 3, since in Comparative Example 1, the Ag-epoxy paste was used, the external electrode formed of the Ag-epoxy paste physically contacted the internal electrode, such that the Rdc value tended to be significantly changed by exposure to high temperature. On the contrary, in Examples 1 and 2, since the external electrode had an IMC networking structure of $Ag_3Sn$ and a connection layer structure composed of a double layer of $Cu_6Sn_5$ and $Cu_3Sn$, there was almost no change in Rdc value in spite of the exposure to the high temperature.

Further, since a standard deviation (STD) of Comparative Example 1 was significantly high as compared to STDs of Examples 1 and 2, it is clear that reliability of the electronic components in Examples 1 and 2 was excellent as compared to Comparative Example 1.

Except for the description described above, a description of features overlapping those of the above-mentioned electronic component according to the exemplary embodiment in the present disclosure will be omitted.

As set forth above, according to exemplary embodiments in the present disclosure, an electronic component capable of having reliability improved by improving a contact property between the internal coil and the external electrode while having a low Rdc value may be provided.

While exemplary embodiments have been shown and described above, it will be apparent to those skilled in the art that modifications and variations could be made without departing from the scope of the present invention as defined by the appended claims.

What is claimed is:

1. An electronic component comprising:

an internal electrode;

an external electrode connected to the internal electrode; and a connection layer disposed between the internal electrode and the external electrode, wherein the external electrode includes a conductive layer having a porous structure, and a resin filled in voids in the porous structure, wherein the conductive layer contains an Ag—Sn based alloy, so that the external electrode has a continuous network structure including an intermetallic compound, and wherein the connection layer includes an intermetallic compound, and the intermetallic compound of the connection layer and the intermetallic compound of the external electrode are in direct contact with each other.

2. The electronic component of claim 1, wherein the Ag—Sn based alloy is $Ag_3Sn$.

3. The electronic component of claim 1, wherein the conductive layer forms the continuous network structure extending from an internal side to an external side of the external electrode.

4. The electronic component of claim 1, wherein the resin is a thermosetting resin.

5. The electronic component of claim 1, wherein the connection layer is formed of a Cu—Sn compound.

6. The electronic component of claim 5, wherein the connection layer is a double layer including a first connection layer adjacent to the external electrode and a second connection layer adjacent to the internal electrode.

7. The electronic component of claim 6, wherein the first connection layer is formed of a $Cu_6Sn_5$ alloy.

8. The electronic component of claim 6, wherein the second connection layer is formed of a $Cu_3Sn$ alloy.

9. The electronic component of claim 6, wherein at least one of the first and second connection layers is discontinuously disposed.

10. The electronic component of claim 1, wherein Bi particles are disposed on a boundary surface of the conductive layer.

11. The electronic component of claim 10, wherein the Ag—Sn based alloy is $Ag_3Sn$.

12. The electronic component of claim 1, wherein Ag particles are irregularly dispersed in the external electrode.

13. The electronic component of claim 1, wherein solder particles of which Sn contents are different from each other are irregularly dispersed in the conductive layer, and the solder particles are formed of a Sn—Bi based alloy.

14. The electronic component of claim 5, wherein the connection layer has an average thickness within a range from 1 μm or more to 10 μm or less.

15. The electronic component of claim 1, wherein in the entire external electrode, an $Ag_3Sn$ intermetallic compound forming an entire backbone of the conductive layer is contained in a content range of 30 vol % to 60 vol %, and Ag particles irregularly dispersed in the conductive layer is contained in a content range of 0 vol % to 3 vol %, and an epoxy filled in the voids in the conductive layer is contained in a content range of 40 vol % to 70 vol %.

16. The electronic component of claim 15, wherein the Ag—Sn based alloy is $Ag_3Sn$.

17. The electronic component of claim 15, wherein Bi particles are disposed on a boundary surface of the conductive layer.

18. An electronic component comprising:

an internal electrode;

an external electrode connected to the internal electrode; and a connection layer disposed between the internal electrode and the external electrode, wherein the external electrode includes a conductive layer including an intermetallic compound, and the conductive layer contains an Ag—Sn based alloy, so that the external electrode has a continuous network structure including the intermetallic compound, wherein the connection layer includes an intermetallic compound, and wherein the intermetallic compound of the connection layer and the intermetallic compound of the external electrode are in direct contact with each other.

19. The electronic component of claim 18, wherein the connection layer includes a first connection layer adjacent to the external electrode and a second connection layer adjacent to the internal electrode.

20. The electronic component of claim 18, wherein the first connection layer is formed of a $Cu_6Sn_5$ alloy and the second connection layer is formed of a $Cu_3Sn$ alloy.

21. The electronic component of claim 18, wherein the conductive layer forms the continuous network structure extending from an internal side to an external side of the external electrode.

* * * * *